United States Patent [19]

Oliver et al.

[11] 4,040,335

[45] Aug. 9, 1977

[54] COVER AND LOCK FOR KEYBOARD OF AN ELECTRONIC ORGAN

[76] Inventors: Ray J. Oliver, 451 S. 1st St., San Jose, Calif. 95113; Stanford M. Sammarcelli, 1357 Loyola Drive, Santa Clara, Calif. 95051

[21] Appl. No.: 658,179

[22] Filed: Feb. 17, 1976

[51] Int. Cl.[2] ..... G10C 3/02

[52] U.S. Cl. ..... 84/183; 84/DIG. 17

[58] Field of Search ..... 84/177-179, 84/183, 352, 453, DIG. 3, DIG. 17

[56] References Cited

U.S. PATENT DOCUMENTS

| | | | |
|---|---|---|---|
| 419,000 | 1/1890 | Whitney | 84/352 |
| 1,017,288 | 2/1912 | Graves | 84/183 |
| 1,960,126 | 5/1934 | Sharp | 84/183 |
| 2,481,103 | 9/1949 | Fuller | 84/179 |
| 3,031,910 | 5/1962 | Lofaro | 84/453 |

*Primary Examiner*—Lawrence R. Franklin
*Attorney, Agent, or Firm*—Leslie M. Hansen

[57] ABSTRACT

A removable dust cover for the stepped keyboard of an electronic organ and means for latching and locking such cover in place between the base, sidewalls and back top member of the console or cabinet confining such keyboard and the use of transparent, tinted and/or colored rigid plastic material fit snugly to the cabinet for protecting the keyboard from contaminents or destructive forces to which such keyboard is accidentally or intentionally subjected.

7 Claims, 8 Drawing Figures

FIG. 3.

FIG. 2.
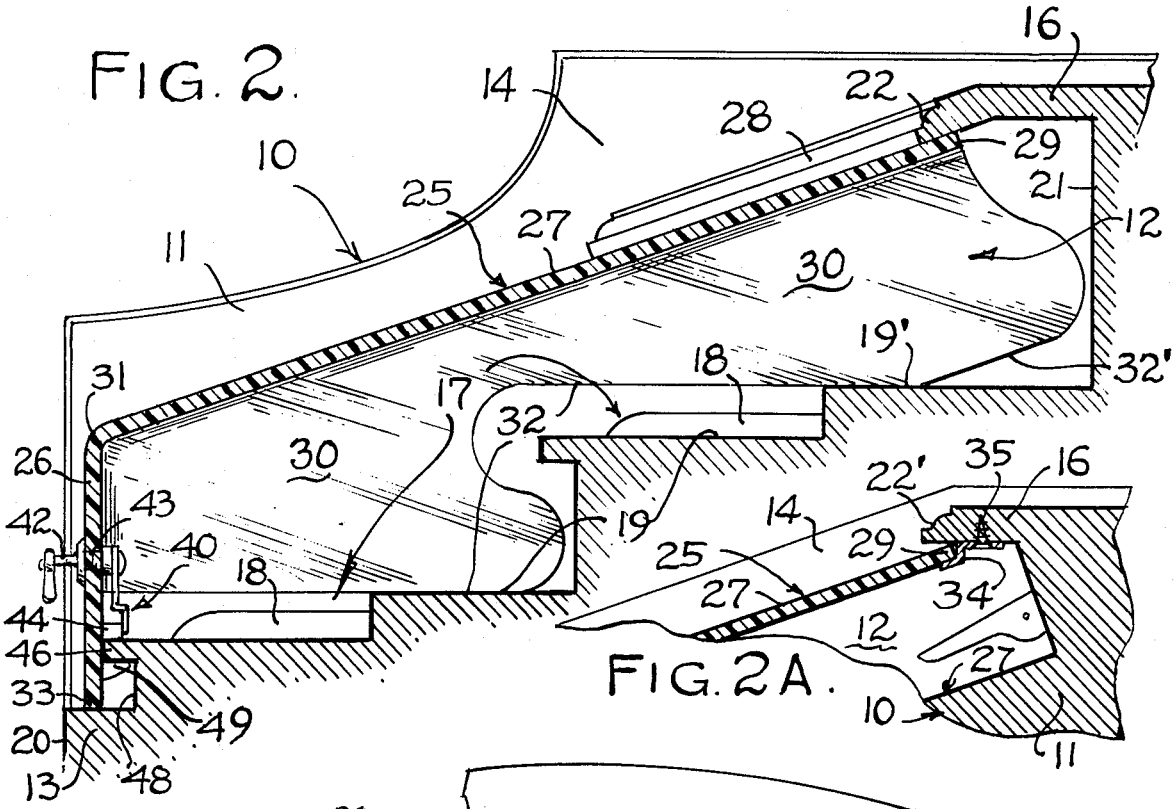
FIG. 2A.
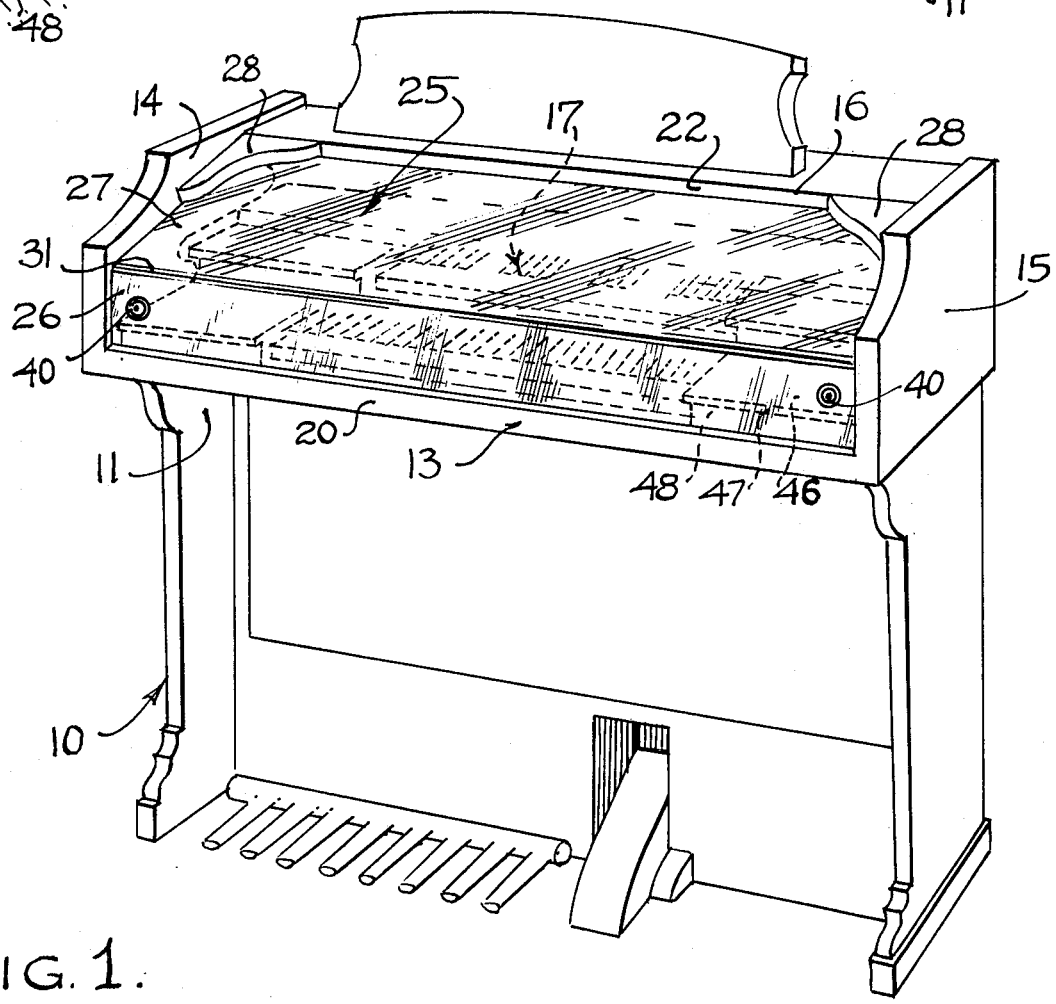
FIG. 1.

COVER AND LOCK FOR KEYBOARD OF AN ELECTRONIC ORGAN

BACKGROUND

This invention relates to a cover for the keyboard of a musical instrument such as an organ, and more particularly for the keyboard of electronic organs.

From its inception the musical organ consists of a keyboard arranged in a console or cabinet somewhat on the order of a piano. Most organs have keyboards arranged in steps with various keys grouped for different tone values and pitches. Although the piano has been provided with a form of keyboard cover, such covers are not suitable or practical for the stepped and grouped key arrangement of an organ.

With electronic type organs, keeping the various circuits, switches and contacts dust-free has become a problem. Moreover the sounds developed in an electronic organ, such as the reed type fidelity of sound depends, upon high frequency vibrations as distinguished from wind as employed in a pipe organ. While pipes are employed in electronic organs, it is the amplification of sounds emitted into such pipes from vibrations created by electronic oscillators that result in true musical tones.

Not only are true tones thus created but the timbre of such tones in an electronic organ are distinguished to imitate that of a piano, violin, guitar, pick-type banjo sounds, wind instruments and even timpan; and drums. While most of the electronic circuitry is well encased and shielded it will be appreciated that any dust, pollutant, film from smoke and kitchen odors as well as dampness to which such circuitry is subjected, can and does effect the high fidelity expected of the sounds electronically created. Any build-up of such contaminents, grit or corrosive conditions on contacts, switches and oscillators may cause short circuiting, frying, i.e., crackling interference or circuit failure and loss of sound entirely at some or all of such components of the instruments.

The present invention contemplates the provision of a cover for the keyboard of electronic organs to alleviate the aforementioned problems.

STATEMENT OF THE INVENTION

This invention has its object the provision of a removable cover adapted to fit over the entire keyboard of an electronic organ.

It is another object to provide a lightweight plastic cover which is rigid and contoured to fit the console walls embracing the keyboard of an electronic organ.

It is yet another object to provide such a cover with latching means for maintaining the cover in place upon the keyboard zone and within the confines of the console or cabinet of the electronic organ to which it is applied.

It is still another object to provide the latching means for such a cover with a locking means to prevent removal of the cover other than by a person having permission to use it.

These and other objects and advantages of the present invention will become apparent in the following description and claims when read in the light of the accompanying two sheets of drawing in which:

FIG. 1 is a perspective view of an organ having a closure over its keyboard illustrating the cover of the present invention in use;

FIG. 2 is a fragmentary section through the keyboard compartment of the organ of FIG. 1 showing the cover thereof in cross section as applied;

FIG. 2A is a modified form of cover for a theater type cabinet and keyboard;

GENERAL DESCRIPTION

Figures 3, 4, 5, 6, 7:
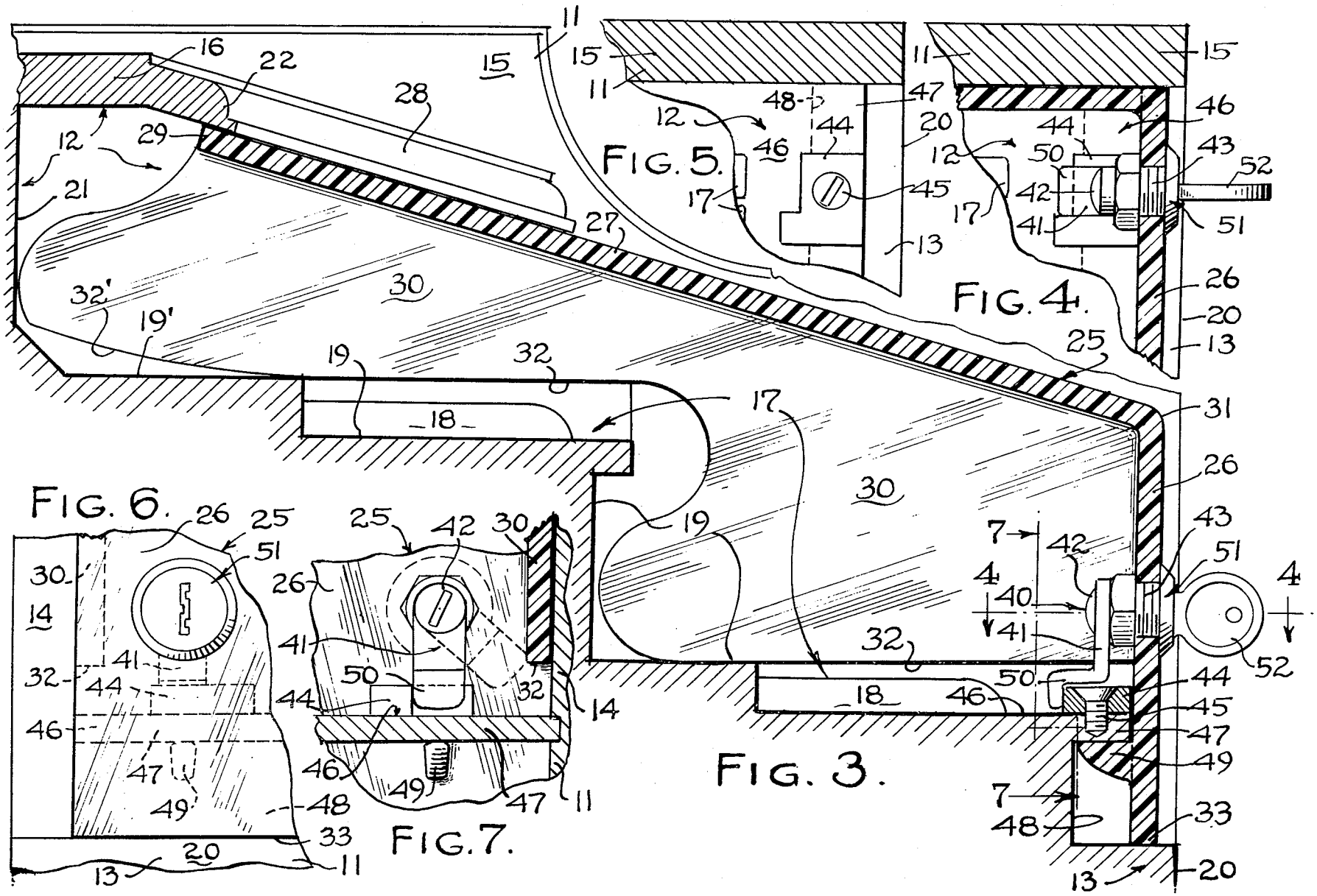
FIG. 3 is a section similar to that of FIG. 2 looking in the opposite direction and at slightly larger scale with respect thereto.
FIG. 4 is a fragmentary horizontal section through the latch and lock of the present invention, a portion of the organ keyboard being in plan view.
FIG. 5 is a plan view similar to that of FIG. 4 with the cover and latch lock removed.
FIG. 6 is a fragmentary front elevational view of the opposite front corner of the organ showing the lock and latch there applied.
FIG. 7 is a fragmentary elevation of the latch and keeper of FIG. 3 as seen from line 7—7 thereof internally of the keyboard cover.

Referring to FIG. 1 of the drawing, an organ generally designated 10 comprises a cabinet 11 of the console type having an upper compartment 12 having a bottom 13 and sidewalls 14 and 15 as well as an offset top 16 confining a keyboard 17. As depicted in FIGS. 2 and 3, the keyboard 17 has a plurality of key tabs 18 arranged in groups and in steps 19 upwardly from the front edge 20 of the bottom wall 13 toward a back wall 21 beneath the fore edge 22 of the top wall 16.

At this point it should be understood that the keyboard 17 may be any style such as piano type as in FIG. 1 or theater type having an oval crown at the front edge 22' of the top wall 16 shown in FIG. 2A. The contour of the cover conforms to the shape and style of the console within which the keyboard to be covered is confined. In this connection it will be noted that the keyboard 17 in either or any type of console is inclined upwardly in banks of keys arranged in steps at higher elevations from the front edge 20 to rear wall 21 in order that an organist can see and reach each bank of keys in a conventional manner.

DETAILED DESCRIPTION OF THE INVENTION

Referring now to the sectional views of FIGS. 2 and 3 through the upper compartment 12 of the cabinet 11, a cover 25 and its application to the console 11 is shown in accordance with the present invention. The cover 25 is preferably, although not necessarily, made of a clear plastic material so that the keys 18 of the keyboard 17 may be visible therethrough for display. Obviously, the plastic material may be tinted or of smoked plexiglass and the like to prevent impingement of sunlight or the heat therefrom upon the keys and keyboard material. Some organ owners, however, may desire opaque material matching the color of the console cabinet 11.

The plastic material from which the cover 25 is made is rigid to withstand buckling in any direction of its span, end to end or fore and aft of the keyboard it overlies. In its simplest form the cover comprises a front portion 26 and a top portion 27 disposed at an incline relative to the front portion 26 at an angle generally dictated by the inclination of the steps 19 of the banks of keys 18 in the fore to aft direction of the keyboard 17.

In the case of the piano type console shown in FIG. 1, the inclined top portion 27 of the cover 25 is disposed to fit under a pair of gussets 28, one at each corner joint of the top 16 with the respective sidewall 14 or 15 of the upper compartment 12 of the console cabinet 11.

In the case of a theater type console the fore edge of the top wall 16 as shown at 22' in FIG. 2A has a half oval shape, highest at midpoint and curving downwardly toward the sidewalls 14–15 at each corner. The uppermost group of keys on the keyboard just beneath the oval shaped edge 22' are usually curved concentric therewith substantially radially of the musician's reach from a sitting position at the organ.

The inclincation of the top portion 27 in either style of keyboard follows the downward trend of the groups of stepped keys. In both styles of cover the inclination of the top portion thereof merges with the front portion 26 by a neat corner bend 31 whereby the front face 26 of the cover stands vertically a distance above the bottom wall 13 of the cabinet adjacent its fore edge 20. By this arrangement the cover 25 is easily placed over the keyboard 17 by supporting the top portion 27 substantially horizontal and inserting its upper edge 29 beneath the extended portion of the top 16 of the cabinet 11. In the case of a deep keyboard, i.e., from its front edge to its back wall 21, the top portion 27 of the cover 25 usually needs side support. Such support is attained by providing skirting 30 at each side edge as depicted in FIGS. 2 and 3. These skirts 30 are welded to the top and front portions and have their lower edges stepped as shown to conform to the steps 19 of the keyboard 17. Moreover, the rearmost step of these skirts have a portion 32' of their lower edges 32 disposed parallel to and at a distance from the bottom surface of the upper portion 27 comparable to the space between the uppermost, inner or back step 19' and the fore edge 22 of the top member 16 of the console 11. By this shape, the entire cover 25 can be inserted horizontally and then rocked downwardly until the lower edge 33 of the front portion 26 of the cover rests upon the upper surface of the shelf-like bottom 13 of the keyboard compartment 12.

When no side skirting 30 is needed, the upper edge of the top portion 27 of the cover 25 is supported by an offset clip 34 secured by a screw 35 to the underside of the top 16 of the console 11 as shown in FIG. 2A.

With the cover 25 in place over the keyboard 17 the latter is protected against dust and other contaminents such as smoke, cooking fumes and the like collecting on the keys 18 and any parts of the electronic components exposed thereto. Moreover, any liquid spilled above the cabinet 11 is deflected away from the keyboard and the circuitry thereof. Persons not authorized to play the organ, such as little children, are prevented from fingering the keys and buttons on the keyboard.

To assure non-removal of the cover 25 a latch mechanism 40 is provided. The latch mechanism 40 includes a latch lever 41 secured to one end of a turn shaft 42 which extends through a bushing 43 mounted on the front portion 26 of the cover 25. The latch lever 41 is adapted to engage behind a keeper 44 (FIG. 7) secured by a screw 45 to a deck 46 forming part of the first step 19 of the keyboard, as shown in FIG. 5. As best seen in FIGS. 3, 6 and 7, a portion 47 of the deck 46 projects forwardly from a first riser 48 from the upper surface of the bottom 13 and not quite as far forwardly as the fore edges of the sidewalls 14 and 15 of the cabinet. This allows space for the entry of a detent 49 formed integrally on the inner face of the front wall portion 26 of the cover 25. The detent 49 is disposed in vertical alignment below the keeper 44 such that the two embrace the forward projection 47 of the deck 46 and the offset 50 formed in the latch lever 41. By this arrangement the cover 25 cannot be removed unless the latch lever 41 is turned out of alignment with the keeper 44 and detent 49 on the front wall 26 of the cover.

As illustrated in FIGS. 3, 4 and 6, the latch lever 41 may also be secured to the turn shaft of a lock mechanism 51 which is key operated. By the use of such lock 51 in combination with the cover 25 and a removable key 52, the keyboard 17 is securely covered so that only persons permitted may gain access thereto. It should be noted that the hand lever shown on the turn shaft in FIG. 2 may also be removable so that none but persons permitted can turn the latch lever to remove the cover.

Having thus described the keyboard cover and lock-on feature thereof in specific detail, it will be appreciated that the same may be susceptible to variations, alterations and/or modifications without departing from the spirit or scope of our invention therein as called for in the appended claims.

What we claim as new and desire to protect by Letters Patent is:

1. For the keyboard of a musical instrument such as an electronic organ and the like having a plurality of groups of keys arranged in steps from its front to its back, a cover comprising in combination:

1. a keyboard compartment having a bottom, side walls and a top member at the back end of such keyboard compartment for confining the keyboard;
2. a sheet of rigid plastic material having side ends engaging the side walls of said keyboard compartment;
3. said plastic material having an upper portion disposed at an inclination substantially conforming to the steps of the groups of keys on said keyboard with its upper end engaged under the top member of the keyboard compartment;
4. said plastic material having a front portion formed integrally with said upper portion disposed vertically adjacent the front edge of the keyboard and having a lower edge adapted to rest upon the upper surface of the bottom of the keyboard compartment for supporting the cover over the keyboard;
5. a forwardly projecting ledge on the first step of said keyboard engaging said vertically disposed front portion of the sheet of plastic material;
6. a detent formed on the back face of said front portion projecting below said forwardly projecting ledge for engaging the underside of the latter; and
7. a latch mechanism between the vertically disposed front portion of said sheet of plastic material and the upper surface of said forwardly projecting ledge for securing said cover to the keyboard;

2. The cover for an electronic organ in accordance with that of claim 1 in which said latch mechanism comprises:

1. a bushing mounted on and extending through said vertically disposed front portion of said rigid plastic material;
2. a turn shaft mounted for turning movement in said bushing;
3. a latch lever secured to the inner end of said turn shaft;
4. a handle on the outer end of said turn shaft; and
5. a keeper plate mounted on the first step of said keyboard adjacent said front portion of said plastic material and having a back face engageable by said latch lever upon turning of said turn shaft for securing the cover to the keyboard.

3. The cover for an electronic organ in accordance with that of claim 2 in which:

1. said keeper plate is secured to the forwardly projecting ledge on the first step of the keyboard vertically above the zone in which the detent on the front portion of the plastic cover engages the lower surface of said ledge; and
2. an offset end on the free end of said latch lever for engaging behind said keeper plate to secure the cover to the keyboard.

4. The cover for an electronic organ in accordance with that of claim 3 including means secured to the underside of the top member of the keyboard compartment and adjacent to the front edge thereof for receiving the back edge of the inclined upper portion of said sheet of plastic material therebetween.

5. The cover for an electronic organ in accordance with that of claim 3 including a skirting member secured to each side end of the inclined and vertical portions of said rigid plastic material and each having a stepped lower edge conforming substantially to the steps of the groups of keys on said keyboard for supporting said cover thereover.

6. The cover for an electronic organ in accordance with that of claim 5 in which said skirting members are rigid plastic material welded to the under and inner faces of said upper and front portions of said cover adjacent the side edges thereof in the form of a brace therebetween.

7. The cover for an electronic organ in accordance with that of claim 6 in which the rearmost stepped lower edge of said side skirting members have a portion thereof disposed parallel to the bottom surface of said upper portion of the plastic material cover in the region of the back edge of the latter and at a spaced relation therefrom comparable to the distance between the top member of the keyboard compartment and the innermost upper step of the stepped keyboard.

* * * * *